US011675293B2

(12) United States Patent
Imaeda et al.

(10) Patent No.: US 11,675,293 B2
(45) Date of Patent: Jun. 13, 2023

(54) IMAGE FORMING APPARATUS INCLUDING A FIXING DEVICE COMPRISING A FIRST NIP PAD AND SECOND NIP PAD AND METHOD FOR CONTROLLING IMAGE FORMING APPARATUS

(71) Applicant: BROTHER KOGYO KABUSHIKI KAISHA, Nagoya (JP)

(72) Inventors: Hirotaka Imaeda, Nagoya (JP); Tomonori Watanabe, Aichi (JP); Tatsuo Ogasawara, Aichi (JP); Shuhei Fukue, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 17/383,038

(22) Filed: Jul. 22, 2021

(65) Prior Publication Data

US 2022/0035284 A1 Feb. 3, 2022

(30) Foreign Application Priority Data

Jul. 30, 2020 (JP) ..... JP2020-128882

(51) Int. Cl.
*G03G 15/20* (2006.01)

(52) U.S. Cl.
CPC ..... *G03G 15/2032* (2013.01); *G03G 15/2064* (2013.01)

(58) Field of Classification Search
CPC ..... G03G 15/2032; G03G 15/2064; G03G 15/2053
See application file for complete search history.

(56) References Cited

U.S. PATENT DOCUMENTS

2008/0205924 A1 8/2008 Fujimoto
2011/0318073 A1* 12/2011 Arikawa ..... G03G 15/206 399/329
2016/0274518 A1* 9/2016 Akatsuka ..... G03G 15/2028
2017/0205743 A1 7/2017 Kamiya et al.
2017/0219971 A1 8/2017 Kamiya

FOREIGN PATENT DOCUMENTS

JP 10-228200 A 8/1998
JP 2008-216280 A 9/2008
JP 2008-233133 A 10/2008
(Continued)

*Primary Examiner* — Arlene Heredia
(74) *Attorney, Agent, or Firm* — Merchant & Gould P.C.

(57) ABSTRACT

An image forming apparatus includes a first fixing member, a second fixing member, and a controller. The second fixing member includes a first nip forming member and a second nip forming member each configured to nip an endless belt in combination with the first fixing member to form a nip region. A first end face on a first-fixing-member side of the first nip forming member is located closer, than a second end face on a first-fixing-member side of the second nip forming member, to the first fixing member. The controller is capable of executing a first printing process performed in a nip region formed between each of the first nip forming member and the second nip forming member and the first fixing member, and a second printing process performed in a nip region formed between only the first fixing member and the first fixing member.

20 Claims, 9 Drawing Sheets

(56) References Cited

FOREIGN PATENT DOCUMENTS

| | | | |
|---|---|---|---|
| JP | 2012-8394 | A | 1/2012 |
| JP | 2014-191039 | A | 10/2014 |
| JP | 2017-116585 | A | 6/2017 |
| JP | 2017-125969 | A | 7/2017 |
| JP | 2017-138363 | A | 8/2017 |

* cited by examiner

IMAGE FORMING APPARATUS INCLUDING A FIXING DEVICE COMPRISING A FIRST NIP PAD AND SECOND NIP PAD AND METHOD FOR CONTROLLING IMAGE FORMING APPARATUS

CROSS-REFERENCE TO RELATED APPLICATION(S)

This application claims priority from Japanese Patent Application No. 2020-128882 filed on Jul. 30, 2020, the disclosure of which is incorporated herein by reference in its entirety.

TECHNICAL FIELD

The present disclosure relates to an image forming apparatus comprising a fixing device with a variable nip width and a method for controlling the image forming device.

BACKGROUND ART

An image forming apparatus conventionally known in the art includes a heating roller, an endless belt, a rigid member and an elastic member each of which nips the endless belt in combination with the heating roller, a first supporting plate that supports the rigid member, a second supporting plate that supports the elastic member, an arm that supports the supporting plates, a first spring that biases the rigid member and the elastic member toward the heating roller via the arm, and a cam which changes the position of the arm. The first supporting plate is fixed on the arm, and the second supporting plate is supported movably on the arm. A second spring is provided between the second supporting plate and the arm. The second spring biases the second supporting plate toward the heating roller.

When a sheet of paper other than an envelope is subjected to printing, the cam is kept out of contact with the arm and a nip region is formed by pressing the rigid member and the elastic member against the heating roller. When an envelope is subjected to printing, the arm is pressed by the cam in a direction away from the heating roller to move the rigid member apart from the heating roller, whereas the second supporting plate is biased by a biasing force of the second spring toward the heating roller. Thereby, only the elastic member is moved relative to the rigid member, and pressed against the heating roller to form a nip region.

SUMMARY

The above-described conventionally known art has a complex structure since a mechanism for relatively moving the rigid member and the elastic member is required.

It would be desirable to provide a simple structure for switching between a mode for printing performed in a nip region formed by two members (nip forming members) and a mode for printing performed in a nip region formed by only one member.

In one aspect, an image forming apparatus disclosed herein comprises a first fixing member including a roller, and a second fixing member configured to nip a sheet in combination with the first fixing member. The second fixing member includes an endless belt, a first nip forming member and a second nip forming member which are each configured to nip the endless belt in combination with the first fixing member to form a nip region in which the sheet is nipped between the endless belt and the roller, and a holder configured to support the first nip forming member and the second nip forming member.

The image forming apparatus further comprises a heater that heats the first fixing member or the second fixing member, a guide configured to support the second fixing member in a manner that permits the second fixing member to move with respect to the first fixing member in a predetermined direction toward or away from the first fixing member, a spring configured to bias the second fixing member toward the first fixing member, a cam configured to move the second fixing member in the predetermined direction, and a controller.

A first end face that is a first-fixing-member-side surface of the first nip forming member is located closer, than a second end face that is a first-fixing-member-side surface of the second nip forming member, to the first fixing member.

The controller is capable of executing a first printing process in which printing is performed with the second fixing member located in a position where both of the first nip forming member and the second nip forming member nip the endless belt in combination with the first fixing member, and a second printing process in which printing is performed with the second fixing member located in a position where the first nip forming member nips the endless belt in combination with the first fixing member, but the second nip forming member does not nip the endless belt in combination with the first fixing member.

In another aspect, a method for controlling an image forming apparatus including a fixing device is disclosed. The fixing device comprises a first fixing member, and a second fixing member configured to nip a sheet in combination with the first fixing member. The second fixing member includes an endless belt, a first nip forming member and a second nip forming member which are each configured to nip the endless belt in combination with the first fixing member to form a nip region in which the sheet is nipped between the endless belt and the roller, and a holder configured to support the first nip forming member and the second nip forming member.

The fixing device further comprises a heater, and a guide configured to support one of the first fixing member and the second fixing member in a manner that permits one of the first fixing member and the second fixing member to move with respect to the other of the first fixing member and the second fixing member, in a predetermined direction toward or away from the other of the first fixing member and the second fixing member.

A first end face that is a first-fixing-member-side surface of the first nip forming member is located closer, than a second end face that is a first-fixing-member-side surface of the second nip forming member, to the first fixing member.

The method comprises executing a first printing process in which printing is performed with the one of the first fixing member and the second fixing member located in a position where both of the first nip forming member and the second nip forming member nip the endless belt in combination with the first fixing member, and a second printing process in which printing is performed with the one of the first fixing member and the second fixing member located in a position where the first nip forming member nips the endless belt in combination with the first fixing member, but the second nip forming member does not nip the endless belt in combination with the first fixing member.

In yet another aspect, an image forming apparatus including a fixing device is disclosed. The fixing device comprises a roller, an endless belt, a first pad configured to nip the endless belt in combination with the roller, a second pad configured to nip the endless belt in combination with the roller, a holder configured to support the first pad and the second pad, a heater, a guide configured to support the holder in a manner that permits the holder to move with respect to the roller in a predetermined direction toward or away from the roller, a spring configured to bias the holder toward the roller, and a cam configured to move the holder in the predetermined direction.

A first end face that is a roller-side surface of the first pad is located closer, than a second end face that is a roller-side surface of the second pad, to the roller.

The image forming apparatus is capable of executing a first printing process in which printing is performed with the holder located in a position where both of the first pad and the second pad nip the endless belt in combination with the roller, and a second printing process in which printing is performed with the holder located in a position where the first pad nips the endless belt in combination with the first fixing member, but the second pad does not nip the endless belt in combination with the first fixing member.

BRIEF DESCRIPTION OF THE DRAWINGS

The above and other aspects, their advantages and further features will become more apparent by describing in detail illustrative, non-limiting embodiments thereof with reference to the accompanying drawings, in which.

DESCRIPTION OF EMBODIMENTS

A detailed description will be given of a non-limiting embodiment with reference made to the drawings where appropriate.

Figure 1:
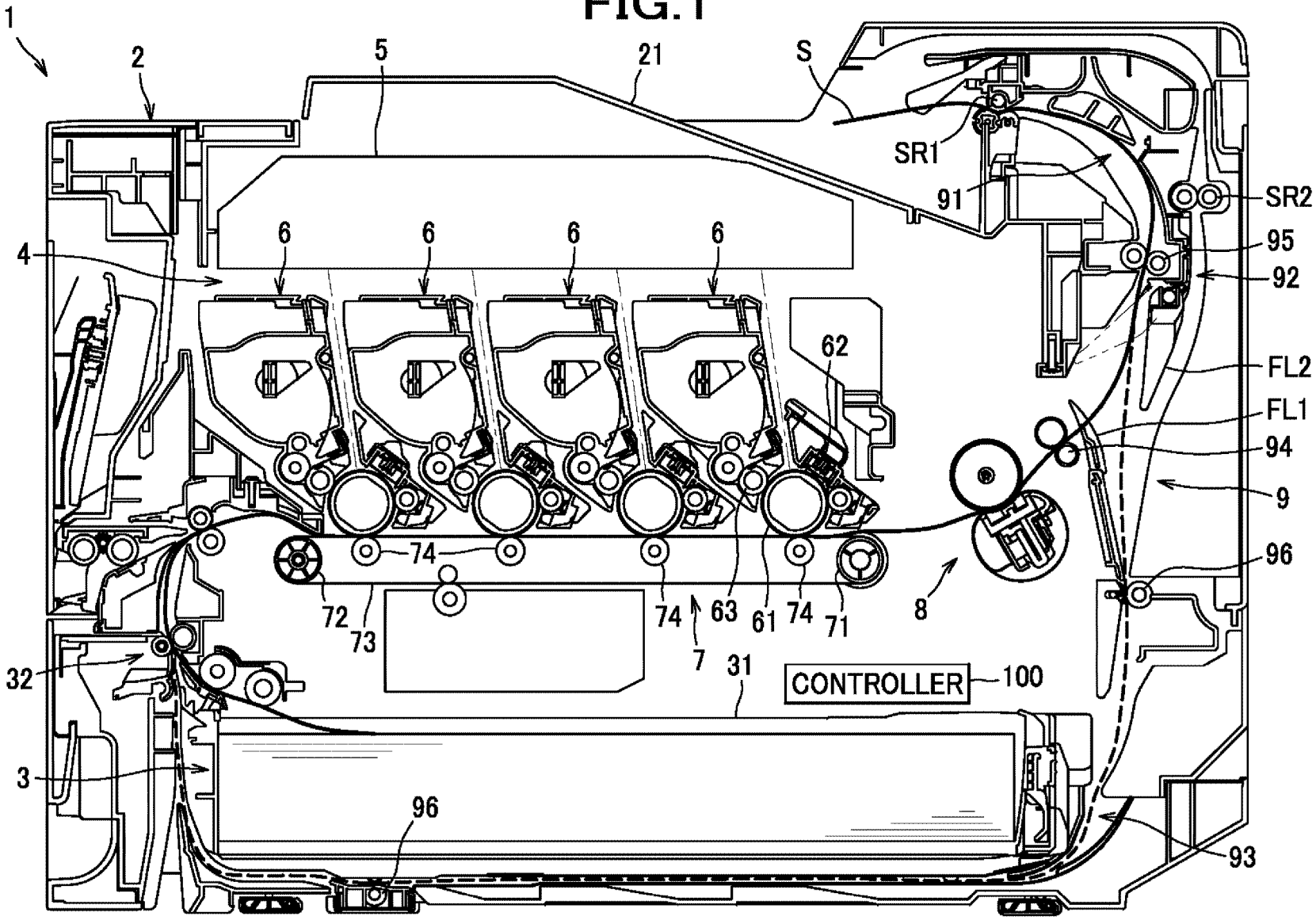
FIG. 1 is a section view of a color printer.

As shown in FIG. 1, a color printer 1 as one example of an image forming apparatus comprises a housing 2, and several units arranged inside the housing 2, which include a feeder unit 3, an image forming unit 4, a fixing device 8, a conveying unit 9, and a controller 100.

The housing 2 comprises an output tray 21. The output tray 21 is formed on a top surface of the housing 2.

The feeder unit 3 is arranged in a lower part of the housing 2. The feeder unit 3 comprises a sheet tray 31 that holds sheets S, and a feeding mechanism 32 for feeding the sheets S in the sheet tray 31 to the image forming unit 4.

The image forming unit 4 has a function of transferring a toner image onto a sheet S to form an image on the sheet S and comprises an exposure device 5, four process cartridges 6, and a transferring unit 7.

The exposure device 5 is provided in an upper part of the housing 2, and comprises a light source, a polygon mirror, etc. (not shown). The exposure device 5 is configured to rapidly scan a surface of each of photoconductor drums 61 with a light beam, to thereby expose the surface of each photoconductor drum 61 to light.

Each process cartridge 6 comprises the photoconductor drum 61, a charger 62, and a development roller 63. The four process cartridges 6 respectively contain toners of yellow, magenta, cyan, and black.

The transferring unit 7 comprises a drive roller 71, a follower roller 72, a conveyor belt 73, and four transfer rollers 74. The conveyor belt 73 is an endless belt and is looped around the drive roller 71 and the follower roller 72. The transfer rollers 74 are positioned on the inner side of the conveyor belt 73. The conveyor belt 73 is held between the transfer rollers 74 and corresponding photoconductor drums 61.

The charger 62 charges the surface of the photoconductor drum 61. Thereafter, the exposure device 5 exposes the charged surface of the photoconductor drum 61 to light to form an electrostatic latent image on the surface of the photoconductor drum 61.

The development roller 63 supplies toner to the electrostatic latent image formed on the surface of the photoconductor drum 61. Accordingly, a toner image is formed on the photoconductor drum 61. When a sheet S is conveyed by the conveyor belt 73 through between the photoconductor drum 61 and the transfer roller 74, the toner image on the surface of the photoconductor drum 61 is transferred onto the sheet S.

The fixing device 8 thermally fixes a toner image on a sheet S. The details of the fixing device 8 will be described later.

The conveying unit 9 is configured to convey a sheet S ejected from the fixing device 8 to the outside of the housing 2 or toward the image forming unit 4 again. The conveying unit 9 comprises a first conveyance path 91, a second conveyance path 92, a reconveyance path 93, a first conveyance roller 94, a second conveyance roller 95, a first switchback roller SR1, a second switchback roller SR2, a plurality of reconveyance rollers 96, a swingable first flapper FL1, and a swingable second flapper FL2.

The first conveyance path 91 guides a sheet S ejected from the fixing device 8 toward the output tray 21. The second conveyance path 92 guides a sheet S ejected from the fixing device 8 toward the output tray 21 along a route different from the first conveyance path 91. The reconveyance path 93 guides a sheet S drawn back into the housing 2, to the feeding mechanism 32 upstream of the image forming unit 4. The sheet S is drawn into the housing 2 by the first switchback roller SR1 and other parts which will be described later. The reconveyance rollers 96 are provided in the reconveyance path 93 and convey a sheet S in the reconveyance path 93 toward the feeding mechanism 32.

The first conveyance roller 94 is provided in the fixing device 8. The first conveyance roller 94 conveys a sheet S with a toner image thermally fixed thereon toward the second flapper FL2.

The second conveyance roller 95, the first switchback roller SR1, and the second switchback roller SR2 are rotatable in forward and reverse directions. The second conveyance roller 95, the first switchback roller SR1, and the second switchback roller SR2 convey a sheet S toward the outside of the housing 2, specifically toward the output tray 21 when rotated in the forward direction, and draw a sheet S back into the housing 2 when rotated in the reverse direction.

The second conveyance roller 95 and the first switchback roller SR1 are provided in the first conveyance path 91. The first switchback roller SR1 is located closer, than the second conveyance roller 95, to the output tray 21. The second switchback roller SR2 is provided in the second conveyance path 92.

In the conveying unit 9, the appropriate switching of the positions of each of the first flapper FL1 and the second flapper FL2 allows a sheet S to be conveyed selectively from the fixing device 8 toward the first conveyance path 91 or the second conveyance path 92, or from the first conveyance path 91 or the second conveyance path 92 to the reconveyance path 93.

Figure 2:
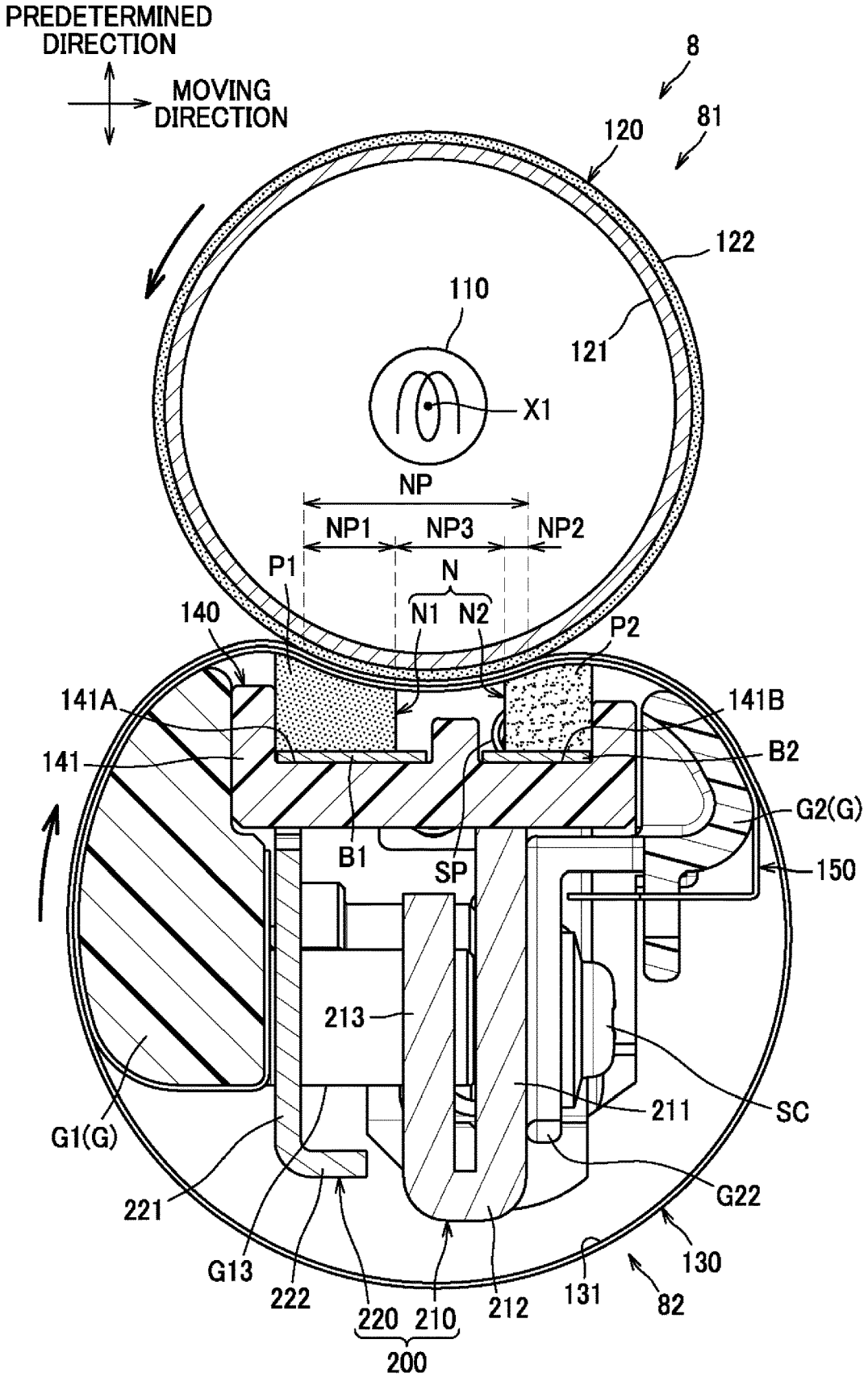
FIG. 2 is a section view of a fixing device.

As shown in FIG. 2, the fixing device 8 includes a first fixing member 81 and a second fixing member 82 that nips a sheet S in combination with the first fixing member 81. The first fixing member 81 includes a heater 110 and a roller 120.

The heater 110 is a halogen lamp which, when energized, generates light and heat and heats the roller 120 by radiant heat transfer. The heater 110 is disposed inside the roller 120 along the axis of rotation of the roller 120. The direction along the axis of the roller 120 is the axial direction of the first fixing member 81 and is also simply referred to as "axial direction".

The roller 120 has a tublar shape and is heated by the heater 110. The roller 120 comprises a tube blank 121 made of metal or the like, and an elastic layer 122 which covers the outer peripheral surface of the tube blank 121. The elastic layer 122 is made of rubber, such as silicone rubber. In the illustrated fixing device, the roller 120 has a concave shape. That is, the external diameters of the roller 120 at both ends of the roller 120 are larger than an external diameter of the roller 120 at a midsection of the roller 120, and the external diameters of the roller 120 gradually increase from the midsection toward the ends in the axial direction. However, the shape of the roller 120 is not limited to the above. The roller 120 may, for example, have a cylindrical shape with a uniform external diameter. Further, the roller 120 may have a crown shape with external diameters gradually decreasing from the midsection toward both ends in the axial direction.

The ends of the roller 120 are rotatably supported on a frame FL, specifically, on side frames 83, which will be described later. A driving force received from a motor (not shown) provided in the housing 2 causes the roller 120 to rotate in a counterclockwise direction of FIG. 2.

The second fixing member 82 is permitted to move with respect to the first fixing member 81 in a predetermined direction toward or away from the first fixing member 81. The predetermined direction is orthogonal to the axial direction. The second fixing member 82 is biased toward the first fixing member 81 by a pressure control mechanism 300 (see FIG. 4) which will be described later.

The second fixing member 82 includes an endless belt 130, a nip forming member N, a holder 140, a stay unit 200, a belt guide G, and a slide sheet 150.

The belt 130 is a flexible member having a shape of a long tube. The belt 130, though not illustrated, includes a base made of metal, plastic or the like, and a release layer which covers an outside surface of the base. The belt 130 is caused to rotate by friction with the roller 120 or the sheet S in the clockwise direction of FIG. 2 according as the roller 120 rotates. A lubricant, such as grease, is applied on an inside surface 131 of the belt 130. Inside of the belt 130, the nip forming member N, the holder 140, the stay unit 200, the belt guide G, and the slide sheet 150 are disposed.

Figure 3:
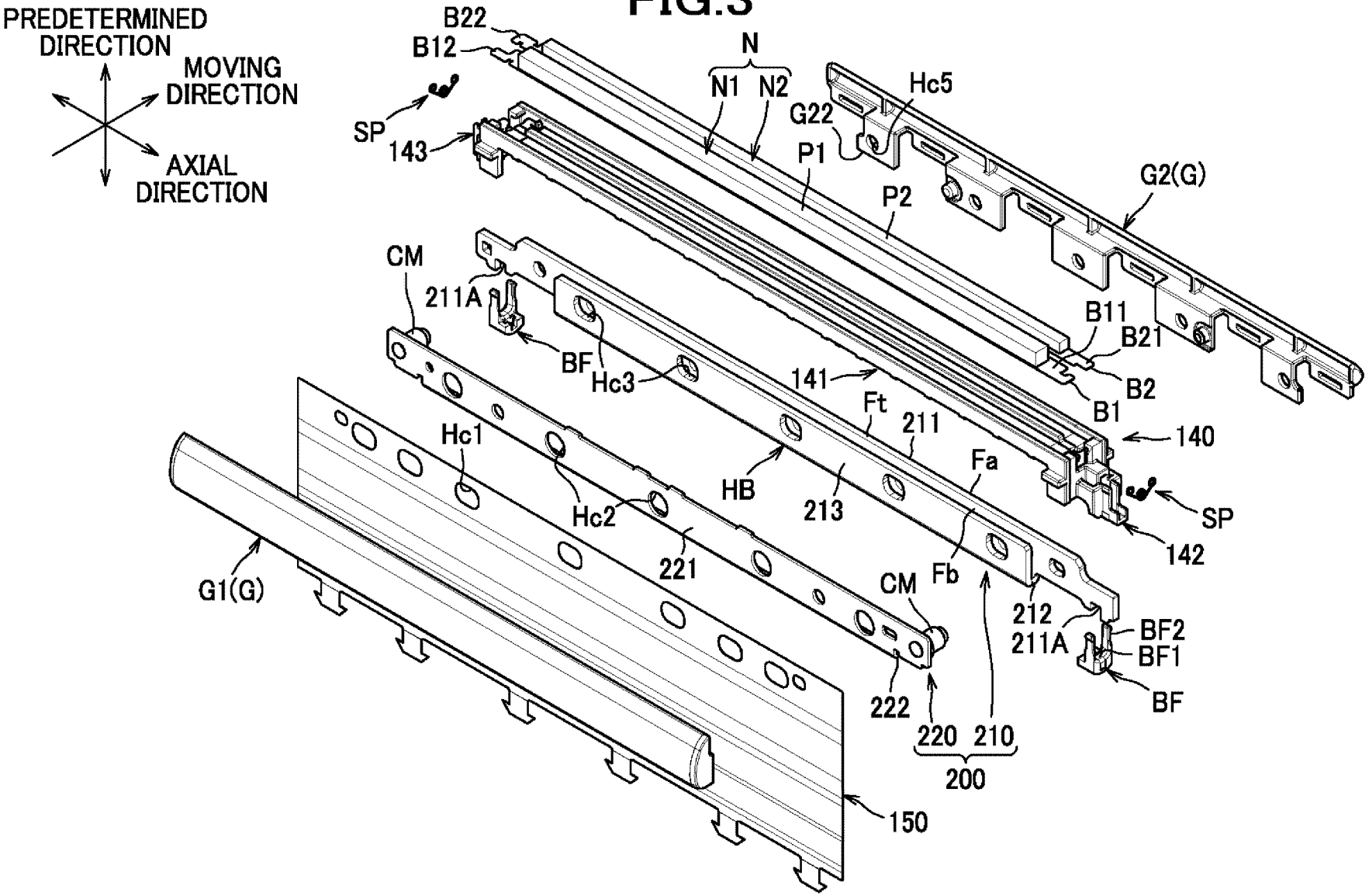
FIG. 3 is an exploded perspective view showing members arranged inside a belt.

In other words, the nip forming member N, the holder 140, the stay unit 200, the belt guide G, and the slide sheet 150 are surrounded by the belt 130. As shown in FIG. 3, the nip forming member N, the holder 140, the stay unit 200, the belt guide G, and the slide sheet 150 have dimensions in the axial direction that are larger than dimensions in any direction orthogonal to the axial direction As shown in FIG. 2 and FIG. 3, the nip forming member N is configured to nip the belt 130 in combination with the roller 120 to form a nip region NP. The nip forming member N includes a first nip forming member N1 and a second nip forming member N2.

The first nip forming member N1 comprises a first pad P1 and a first fastening plate B1.

The first pad P1 is a rectangular parallelepiped member. The first pad P1 is made of rubber, such as silicone rubber. The first pad P1 nips the belt 130 in combination with the roller 120 to form an upstream nip region NP1.

In this description, the direction of movement of the belt 130 in the upstream nip region NP1, or the nip region NP which will be described in detail later, is simply referred to as "moving direction". Although the moving direction is a direction along the outer peripheral surface of the roller 120, it is illustrated as a direction perpendicular to the predetermined direction and to the axial direction, because the moving direction is substantially the same as the direction perpendicular to the predetermined direction and to the axial direction. It is to be understood that the moving direction is the same direction as a direction of conveyance of a sheet S in the nip region NP. In the following description, upstream and downstream in the moving direction will be simply referred to as "upstream" and "downstream".

The first pad P1 is fixed to a roller 120-side surface of the first fastening plate B1. The upstream end of the first pad P1 is located slightly upstream farther than the upstream end of the first fastening plate B1, in the moving direction. Accordingly, the upstream end of the first pad P1 contacts the holder 140.

The first fastening plate B1 is made of a material harder than that of the first pad P1. For example, the first fastening plate B1 may be made of metal. The length of the first fastening plate B1 in the axial direction is longer than that of the first pad P1. The ends B11, B12 of the first fastening plate B1 are located outward of the ends of the first pad P1, in the axial direction.

The second nip forming member N2 is located downstream in the moving direction and spaced apart from the first nip forming member N1. That is, the second nip forming member N2 is located apart from the first nip forming member N1 in the moving direction. The second nip forming member N2 comprises a second pad P2 and a second fastening plate B2.

The second pad P2 is a rectangular parallelepiped member. The second pad P2 is made of rubber, such as silicone rubber. The second pad P2 nips the belt 130 in combination with the roller 120 to form a downstream nip region NP2. The second pad P2 is located apart from the first pad P1 in the moving direction.

Accordingly, between the upstream nip region NP1 and the downstream nip region NP2, there exists an intervening nip region NP3 in which no pressure is directly exerted from the second fixing member 82. In this intervening nip region NP3, the belt 130 is in contact with the roller 120, but almost no pressure is exerted because there is no counterpart member which nips the belt 130 in combination with the roller 120. Therefore, when a sheet S passes through the intervening nip region NP3, the sheet S is subjected to heat from the roller 120 but to almost no pressure. In this description, the whole region from an upstream end of the upstream nip region NP1 to a downstream end of the downstream nip region NP2, i.e., the whole region in which the outside surface of the belt 130 and the roller 120 contact each other is referred to as "nip region NP". In other words, in this example, the nip region NP includes a region in which pressing forces from the first pad P1 and the second pad P2 are not exerted.

The second pad P2 is fixed to a roller 120-side surface of the second fastening plate B2. The downstream end of the second pad P2 is located slightly downstream farther than the downstream end of the second fastening plate B1, in the moving direction. Accordingly, the downstream end of the second pad P2 contacts the holder 140. As shown in FIG. 7, the dimension of the second pad P2 in the predetermined direction is smaller than that of the first pad P1.

As shown in FIG. 3, the second fastening plate B2 is made of a material harder than that of the second pad P2. For example, the second fastening plate B2 may be made of metal. The length of the second fastening plate B2 in the axial direction is longer than that of the second pad P2. The ends B21, B22 of the second fastening plate B2 are located outward of the ends of the second pad P1, in the axial direction. The dimension of the second fastening plate B2 in the predetermined direction is the same as that of the first fastening plate B1.

The first pad P1 has a hardness greater than a hardness of the elastic layer 122 of the roller 120. The second pad P2 has a hardness greater than the hardness of the first pad P1. That is, the first pad P1 is softer than the second pad P2.

The hardness herein refers to durometer hardness as specified in ISO 7619-1. The durometer hardness is a value determined from the depth of an indentation in a test piece created by the standardized indenter under specified conditions. For example, where the elastic layer 122 has a durometer hardness of 5, it is preferable that the first pad P1 has a durometer hardness in a range of 6 to 10, and the second pad P2 has a durometer hardness in a range of 70 to 90.

Hardness of silicone rubber may be adjusted by changing the percentage of additives (silica-based fillers or carbon-based fillers) added during manufacture. To be more specific, if the percentage of additives is increased, the hardness of silicone rubber increases. The hardness of silicone rubber can be reduced by the addition of silicone-based oil. Liquid injection molding and extrusion molding may be used for manufacturing rubber. In general, liquid injection molding is suitable for rubber with a low hardness, and extrusion molding is suitable for rubber with a high hardness.

The first nip forming member N1 and the second nip forming member B2 are respectively biased toward directions away from each other by springs SP. Each spring SP is a torsion spring with a coil supported on the holder 140, one end in contact with the first nip forming member N1, and the other end in contact with the second nip forming member N2. The springs SP are provided at both ends of the holder 140.

The holder 140 is a member that holds the nip forming member N. That is, the first nip forming member N1 and the second nip forming member N2 are supported by one holder 140. The holder 140 is made of plastic or other material having a heat-resisting property. The holder 140 comprises a holder base 141 and two engagement portions 142, 143.

The holder base 141 is a portion that holds the nip forming member N. The holder base 141 is mostly located within a space surrounded by the belt 130, in the axial direction. The holder base 141 is supported by the stay unit 200 (a first stay 210 and a second stay 220 which will be described later).

As shown in FIG. 2, the holder base 141 has a first support surface 141A and second support surface 141B. The first support surface 141A supports a surface of the first nip forming member N1 facing away from the first fixing member 81. The second support surface 141B supports a surface of the second nip forming member N2 facing away from the first fixing member 81. The first support surface 141A and the second support surface 141B are located at the same position in the predetermined direction.

Accordingly, as shown in FIG. 7, the first nip forming member N1 is located closer, than the second nip forming member N2, to the first fixing member 81. In other words, a first end face N11 that is a first-fixing-member 81-side surface of the first nip forming member N1 is located closer in the predetermined direction, than a second end face N21 that is a first-fixing-member 81-side surface of the second nip forming member N2, to the first fixing member 81. Specifically, in a state where the nip forming members N1, N2 are not pressed against the first fixing member 81, the first end face N11 is located closer, than the second end face N21, to the first fixing member 81.

In FIG. 7, only a part of the first end face N11 of the first nip forming member N1 is pressed against the first fixing member 81 and pressure is not exerted on the other part of the first end face N11 or the second end face N21. Thus, the other part of the first end face N11 and the second end face N21 are located in the same positions as the positions in which they are located when the nip forming members N1, N2 are not pressed against the first fixing member 81. That is, the other part of the first end face N11 is located closer, than the second end face N21, to the first fixing member 81. In other words, the shortest distance D1 between the part of the first end face N11 on which no pressure is exerted and the outer peripheral surface of the first fixing member 81 is shorter than the shortest distance D2 between the second end face on which pressure is not exerted and the outer peripheral surface of the first fixing member 81.

As shown in FIG. 3, the engagement portions 142, 143 are respectively provided at the ends of the holder base 141. The engagement portions 142, 143 are located outside the space surrounded by the belt 130, in the axial direction. The engagement portions 142, 143 are respectively engaged with the corresponding ends of a first stay 210 which will be described below.

The stay unit 200 is a member located on a side of the holder 140 opposite to the nip forming member N to support the holder 140. The stay unit 200 comprises a first stay 210 and a second stay 220.

The first stay 210 is a member that supports the holder base 141 of the holder 140. The first stay 210 is made of metal or the like. The first stay 210 includes a base portion 211, and a hemmed portion HB.

The base portion 211 has, on a side facing the holder 140, a contact surface Ft that contacts the holder base 141 of the holder 140. The contact surface Ft is a flat surface perpendicular to the predetermined direction. The base portion 211 is formed as a downstream wall located downstream of the hemmed portion HB in the moving direction. The base portion 211 has a downstream surface Fa located downstream in the moving direction and an upstream surface Fb located upstream in the moving direction.

The hemmed portion HB is a portion bent by a hemming process. The hemmed portion HB is bent from one end of the base portion 211 and extends towards the other end of the base portion 211. The hemmed portion HB includes a bent portion 212 which is a portion bent to extend upstream from the one end of the base portion 211 and an upstream wall 213 extending from the upstream end of the bent portion 212 toward the holder base 141. The upstream wall 213 is located on an upstream side of the base portion 211 which is a downstream wall, in the moving direction. The upstream wall 213 is oriented parallel to the base portion 211. The upstream wall 213 faces the base portion 211 in the moving direction and is spaced apart from the base portion 211 by a spacing smaller than the thickness of the first stay 210.

The length of the hemmed portion HB in the axial direction is shorter than that of the base portion 211. The ends of the base portion 211 are located outward of the ends of the hemmed portion HB, in the axial direction.

The base portion 211 includes, at both ends, load-receiving portions 211A that receive forces from the pressure control mechanism 300 (see FIG. 4) which will be described later. Each load-receiving portion 211A is provided at the end of the base portion 211 opposite to the nip forming member N in the predetermined direction and is comprised of a recess that opens on a side facing away from the nip forming member N in the predetermined direction.

A buffer BF made of plastic or the like is attached to the load-receiving portion 211A. The buffer BF is a member that restrains the base portion 211 made of metal and an arm 310 made of metal (see FIG. 4) which will be described later from rubbing against each other. The buffer BF comprises a fit-on portion BF1 and a pair of leg portions BF2. The fit-on portion BF1 is configured to fit on the load-receiving portion 211A. The leg portions BF2 are located at upstream and downstream sides in the moving direction, respectively, of each of the aforementioned ends of the base portion 211.

The second stay 220 is a member that supports the holder base 141 of the holder 140. The second stay 220 is made of metal or the like. The second stay 220 is located on the upstream side of the first stay 210 in the moving direction. The second stay 220 includes a base portion 221, and an extended portion 222. The base portion 221 is oriented parallel to the upstream wall 213 of the first stay 210. The extended portion 222 extends from an end of the base portion 221 opposite to the nip forming member N toward the first stay 210.

The length of the base portion 221 in the axial direction is longer than that of the extended portion 222 and the hemmed portion HB of the first stay 210. The ends of the base portion 221 are located outward of the ends of the extended portion 222 and the ends of the hemmed portion HB, in the axial direction. The ends of the base portion 211 of the first stay 210 and the ends of the base portion 221 of the second stay 220 are connected respectively by a connecting member CM. That is, the connecting member CM is connected to the base portion 211 at a location in the axial direction different from the location of the hemmed portion HB.

The belt guide G is a member that contacts the inside surface 131 to guide the belt 130. The belt guide G is made of plastic or other material having a heat-resisting property. The belt guide G includes an upstream guide G1 and a downstream guide G2.

The slide sheet 150 is a rectangular sheet configured to reduce frictional resistance between each pad P1, P2 and the belt 130. The slide sheet 150 is held at the nip region NP between the inside surface 131 of the belt 130 and each pad P1, P2. The slide sheet 150 is made of an elastically deformable material. It is to be understood that any material can be used for the slide sheet 150; herein, a sheet of plastic containing polyimide resin is used.

As shown in FIG. 2, the upstream guide G1, the downstream guide G2, and the first stay 210 are fastened together using a screw SC. To be more specific, the upper guide G1 has a boss G13 which protrudes in the downstream direction, and the downstream guide G2 has a fixing portion G22 that contacts the head of the screw SC.

The boss G13 is a boss for fixing the upstream guide G1 together with the downstream guide G2 to the first stay 210. The boss G13 extends through holes Hc1, Hc2, Hc3 (see FIG. 3) respectively formed in the slide sheet 150, the second stay 220, and the upstream wall 213 of the first stay 210, and contacts the base portion 211 of the first stay 210. The screw SC extends through a hole Hc5 (see FIG. 3) formed in the fixing portion G22 and a hole (not shown) formed in the base portion 211 of the first stay 210, and is fastened to the end of the boss 13.

Figure 4:
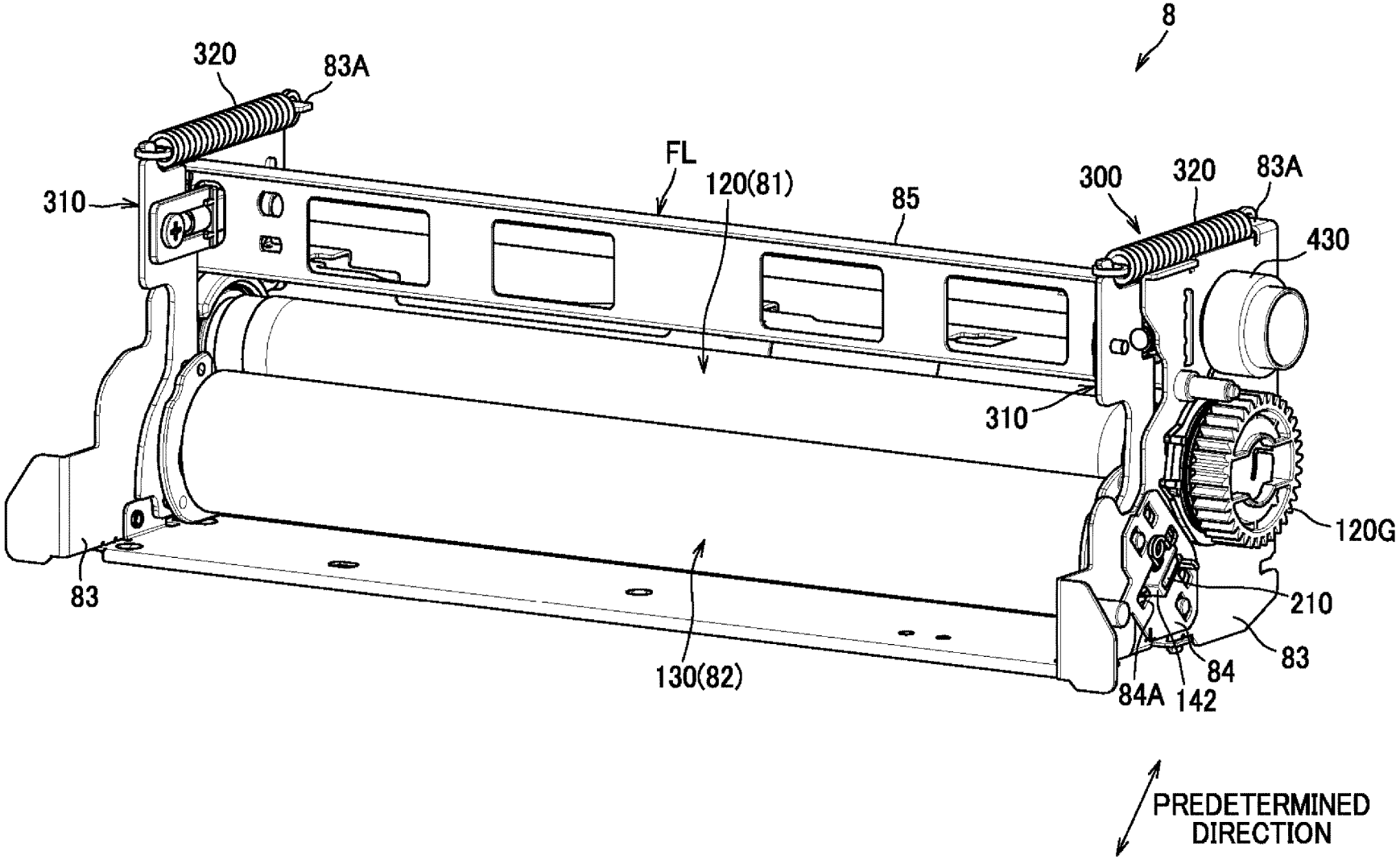
FIG. 4 is a perspective view of a pressure control mechanism.

As shown in FIG. 4, the fixing device 8 includes the frame FL and the pressure control mechanism 300. The frame FL supports the first fixing member 81 and the second fixing member 82. The frame FL is made of metal, or the like. The frame FL includes side frames 83, brackets 84, and a connecting frame 85. The side frames 83 and the brackets 84 are provided at both sides of the first fixing member 81 and the second fixing member 82 facing outward in the axial direction. The connecting frame 85 is connected to the side frames 83.

The side frames 83 support the first fixing member 81 and the second fixing member 82. Each of the side frames 83 includes a spring engagement portion 83A configured to engage with one end of a first spring 320 which will be described later.

The brackets 84 are members that support the second fixing member 82 in a manner that permits the second fixing member 82 to move in the predetermined direction. Each bracket 84 is fixed to the respective side frame 83. To be more specific, each of the brackets 84 provided at both sides in the axial direction has a first slot 84A that supports the engagement portions 142, 143 of the holder 140 in a manner that permits the engagement portions 142, 143 to move along the length of the first slot 84A elongate in the predetermined direction.

Here, the first slot 84A corresponds to a groove as a guide. The engagement portions 142, 143 are respectively inserted in the first slots 84A provided on both sides in the axial direction. Thus, the second fixing member 82 is supported movably in the predetermined direction. The groove as the guide may be a groove with a bottom.

The pressure control mechanism 300 is a mechanism configured to change a nip pressure exerted in the nip region NP. The pressure control mechanism 300 comprises an arm 310, a first spring 320 as an example of a spring, a second spring 330, and a cam 340. The arm 310, the first spring 320, the second spring 330, and the cam 340 are provided at each end of the frame FL in the axial direction.

The arm 310 is a member configured to push the first stay 210 toward the first fixing member 81 with the buffer BF interposed between the arm 310 and the first stay 210. The arm 310 is rotatably supported on the side frame 83 and supports the second fixing member 82

The arm 310 includes an arm body 311 and a cam follower 350. The arm body 311 is an L-shaped plate member made of metal or the like.

The side frame 83 includes a boss 83X by which the arm body 311 is rotatably supported. The arm body 311 includes a first end 311A rotatably supported by the boss 83X of the side frame 83, a second end 311B to which the first spring 320 is connected, and an engagement hole 311C which supports the second fixing member 82. The engagement hole 311C is located between the first end 311A and the second end 311B, and is engaged with the buffer BF.

The arm body 311 further includes a guide protrusion 312 extending toward the cam 340. The guide protrusion 312 is located between the second end 311B and the engagement hole 311C along the length of the arm body 311.

The cam follower 350 is fitted on the guide protrusion 312 of the arm body 311 movably relative to the guide protrusion 312. The cam follower 350 is made of plastic or the like, and includes a tubular portion 351, a contact portion 352, and a flange portion 353. The tubular portion 351 is a portion fitted on the guide protrusion 312. The contact portion 352 is provided at one end of the tubular portion 351. The flange portion 353 is provided at the other end of the tubular portion 351.

The tubular portion 351 is supported, by the guide protrusion 312, movably along the protruding direction of the guide protrusion 312. The contact portion 352 is a wall closing a cam 340-side open end of the tubular portion 351, and is located between the cam 340 and the end of the guide protrusion 312. The flange portion 353 protrudes from the other end of the tubular portion 351 in radial directions perpendicular to a direction of movement of the cam follower 350.

The second spring 330 is disposed between the tubular portion 351 and the arm body 311. Accordingly, the arm body 311 is configured not only to be biased by the first spring 320 but also to be able to be biased by the second spring 330.

The first spring 320 is a spring exerting a first biasing force on the second fixing member 82. Specifically, the first spring 320 is configured to exert the first biasing force on the second fixing member 82 via the arm body 311.

To be more specific, the first spring 320 biases the first pad P1 and the second pad P2 toward the roller 120 via the arm body 311, the buffer BF, the first stay 210, and the holder 140. The first spring 320 is a helical tension spring made of metal or the like, with one end connected to the spring engagement portion 83A of the side frame 83, and the other end connected to the second end 311B of the arm body 311.

The second spring 330 is a spring capable of exerting, on the second fixing member 82, a second biasing force in a direction opposite to a direction of the first biasing force. Specifically, the second spring 330 is configured to be capable of exerting the second biasing force on the second fixing member via the arm body 311. The second spring 330 is a helical compression spring made of metal or the like, and is disposed between the tubular portion 351 and the arm body 311 with the guide protrusion 312 inserted in a space surrounded by the helical compression spring.

The cam 340 is a member that pushes the arm 310 via the cam follower 350 to thereby move the second fixing member 82 in the predetermined direction. The cam 340 is capable of changing the compression state of the second spring 330 to a first compression state in which the second biasing force is not exerted on the second fixing member 82, to a second compression state in which the second biasing force is exerted on the second fixing member 82, and to a third compression state in which the second spring 330 is deformed more than in the second compression state. The cam 340 is rotatably supported by the side frame 83 to rotate to a first cam position shown in FIG. 5A, to a second cam position shown in FIG. 6A, and to a third cam position shown in FIG. 7A.

The cam 340 is made of plastic or the like, and includes a first area 341, a second area 342, and a third area 343. The first area 341, the second area 342, and the third area 343 are located on an outer periphery of the cam 340.

Figure 5A:
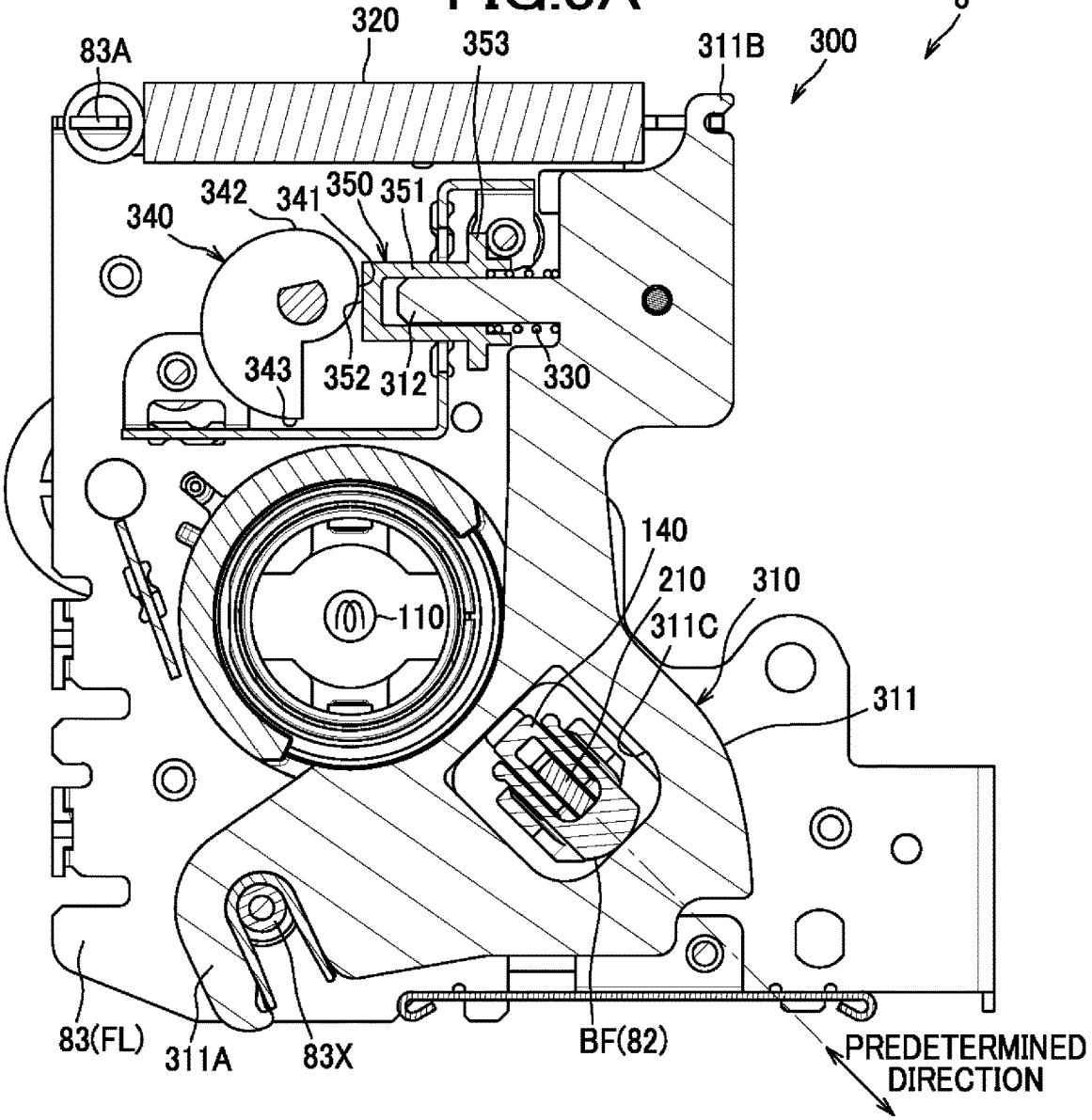
FIG. 5A is a section view of the pressure control mechanism in which a nip pressure is adjusted to a first pressure.

The first area 341 is an area closest to the cam follower 350 when the cam 340 is in the first cam position. As shown in FIG. 5A, when the cam 340 is in the first cam position, the first area 341 is located apart from the cam follower 350.

Figure 6A:
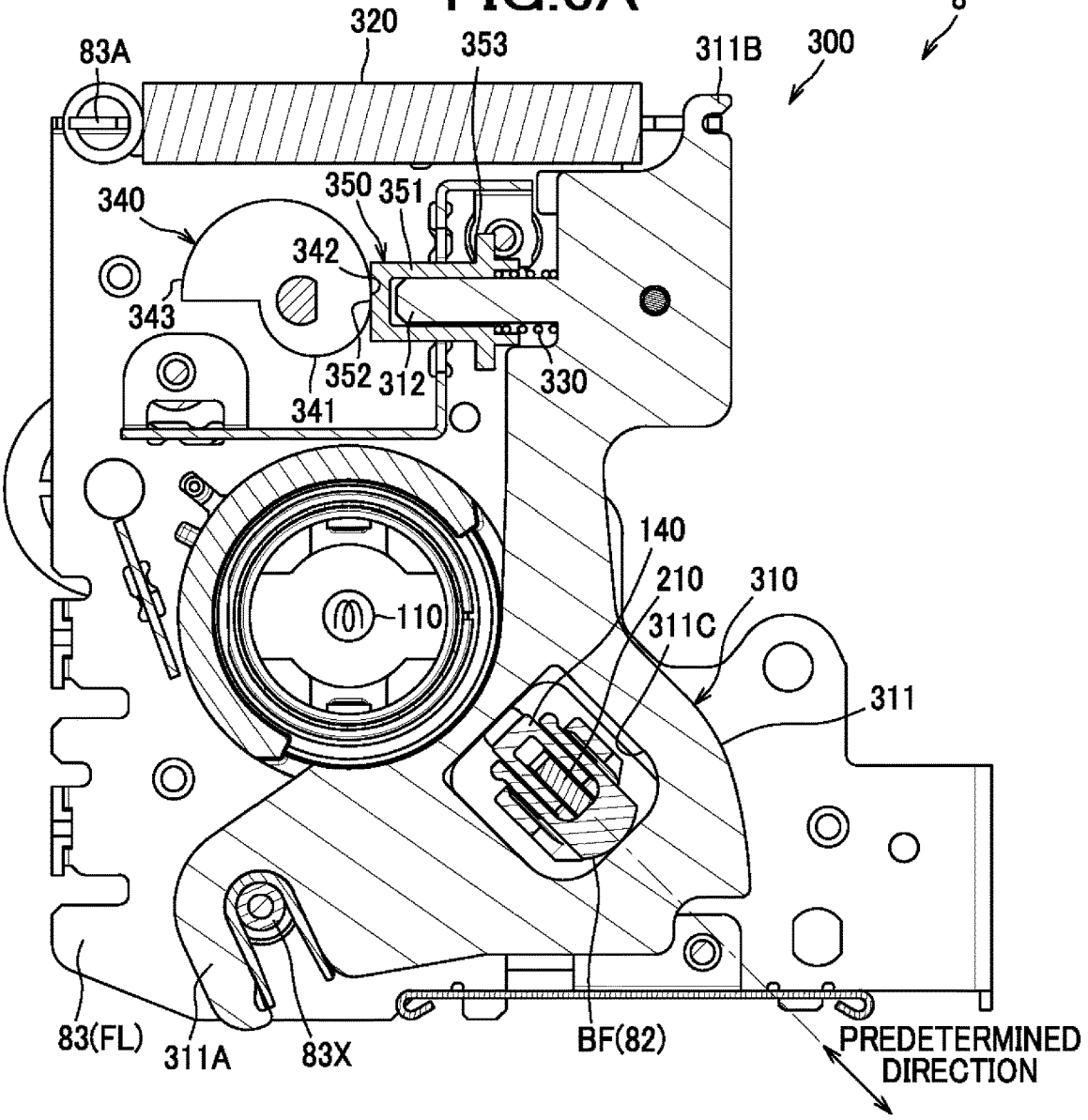
FIG. 6A is a section view of the pressure control mechanism in which a nip pressure is adjusted to a second pressure.

The second area 342 is an area that contacts the cam follower 350 when the cam 340 is in the second cam position. To be more specific, as shown in FIG. 6A, the second area 342 is an area that comes in contact with the cam follower 350 when the cam 340 rotates from the first cam position approximately 90 degrees in the clockwise direction as in the drawing. The distance from the second area 342 to the center of rotation of the cam 340 is greater than the distance from the first area 341 to the center of rotation of the cam 340.

Figure 7A:
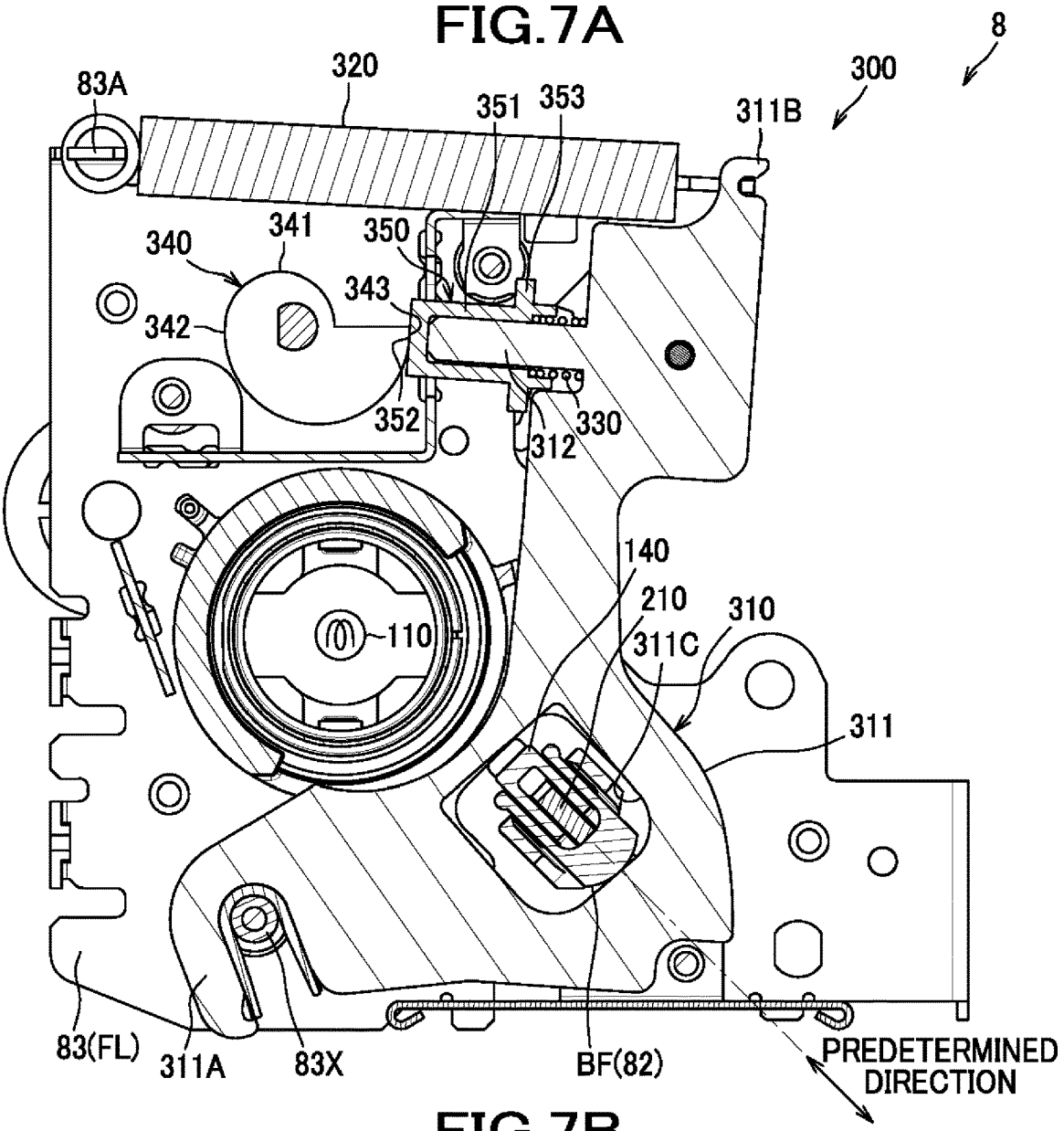
FIG. 7A is a section view of the pressure control mechanism in which a nip pressure is adjusted to a third pressure.

The third area 343 is an area that contacts the cam follower 350 when the cam 340 is in the third cam position. To be more specific, as shown in FIG. 7A, the third area 343 comes in contact with cam follower 350 when the cam 340 rotates from the first cam position approximately 270 degrees in the clockwise direction as in the drawing, in other words, when the cam 340 rotates from the second cam position approximately 180 degrees in the clockwise direction as in the drawing. The distance from the third area 343 to the center of rotation of the cam 340 is greater than the distance from second area 342 to the center of rotation of the cam 340.

When the cam 340 is in the first cam position, the cam 340 is positioned apart from the cam follower 350, and thus the second spring 330 is in the first compression state. In this state, where the cam 340 keeps the second spring 330 in the first compression state, the arm body 311 assumes the first position shown in FIG. 5A.

To be more specific, when the cam 340 keeps the second spring 330 in the first compression state, the second biasing force of the second spring 330 is not exerted via the arm body 311 on the second fixing member 82 because the cam 340 is positioned apart from the cam follower 350, so that only the first biasing force of the first spring 320 is exerted via the arm body 311 on the respective pads P1, P2 of the second fixing member 82. In this state where the first biasing force is exerted on the second fixing member 82 by the first spring 320, but the second biasing force is not exerted on the second fixing member 82 by the second spring 330, the nip pressure is adjusted to a first nip pressure.

In this illustrated example, when the cam 340 keeps the second spring 330 in the first compression state, the second spring 330 is held in a deformed state between the cam follower 350 and the arm body 311. That is, the second spring 330 in the first compression state is not in its equilibrium length but deformed from its equilibrium length. It is understood that even if the second spring 330 in the first compression state is in the deformed state, the second biasing force of the second spring 330 is not exerted on the second fixing member 82 because the cam 340 is apart from the cam follower 350.

When the cam 340 rotates from the first cam position shown in FIG. 5A to the second cam position shown in FIG. 6A, the cam 340 comes in contact with the cam follower 350 and causes the cam follower 350 to move a predetermined distance relative to the arm body 311. Accordingly, when the cam 340 is in the second cam position, the compression state of the second spring 330 changes to the second compression state in which the second spring 330 is deformed more than in the first compression state.

When the cam 340 is in the second cam position, the cam follower 350 is supported by the cam 340, so that the second biasing force of the second spring 330 is exerted via the arm body 311 on the second fixing member 82 in a direction opposite to the direction of the first biasing force. Therefore, where the first biasing force is exerted on the second fixing member 82 by the first spring 320 and the second biasing force is exerted on the second fixing member 82 by the second spring 330, the nip pressure is adjusted to a second nip pressure smaller than the first nip pressure.

When the cam 340 causes the second spring 330 to assume the second compression state, the arm body 311 remains in the first position described above. It is to be understood that the second pad P2 is substantially not deformed when pressed against the roller 120, i.e., the second pad P2 is substantially not deformed when a load is imposed on the second pad P2, regardless of the magnitude of the load. As the second pad P2 is substantially not deformed, the positions of the stay unit 200 supporting the second pad P2, and the arm 310 supporting the stay unit 200 as well, remain substantially unchanged regardless of the magnitude of the load. Moreover, the position of the first pad P1 depends on the position of the second pad P2, and thus remains unchanged when the second pad P2 is substantially not deformed and its position unchanged. Therefore, the entire nip width (distance from an entrance or upstream edge of the upstream nip region NP1 to an exit or downstream edge of the downstream nip region NP2) does not change in either the strong nip condition (first nip pressure) or the weak nip condition (second nip pressure), and the position of the arm 310 remains substantially the same.

The reason that the second pad P2 is not deformed is that the hardness of the second pad P2 is sufficiently greater than the hardness of the first pad P1 and the hardness of the elastic layer 122 of the roller 120. To be more specific, it is because the hardness of the second pad P2 is such that it substantially does not deform by nip pressures required in the downstream nip region NP2 ranging from a maximum nip pressure (downstream nip pressure under the strong nip condition) to a minimum nip pressure (downstream nip pressure under the weak nip condition).

Conversely, the maximum nip pressure and the minimum nip pressure required in the downstream nip region NP2 are set at such levels that the second pad P2 is substantially not deformed.

Here, it is to be understood that "the downstream nip P2 is substantially not deformed" implies that the second pad P2 may be deformed to such a level that change in the nip width (length and position of the nip in the moving direction of the belt) of the downstream nip region NP2 formed by the second pad P2 would not affect the image quality and the sheet conveyance (i.e., the variation in the downstream nip width may not be zero).

Figure 5B:
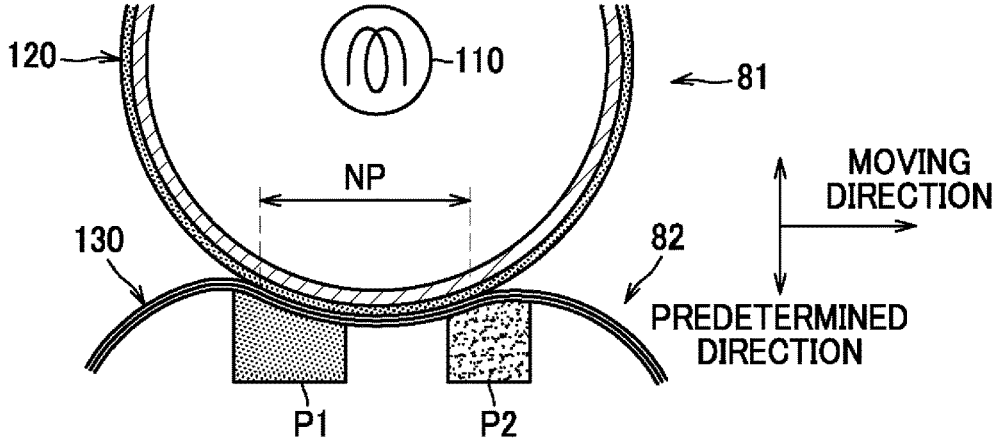
FIG. 5B is a section view showing a nip region, with its surrounding structural features, when the nip pressure is adjusted to the first pressure.
Figure 6B:
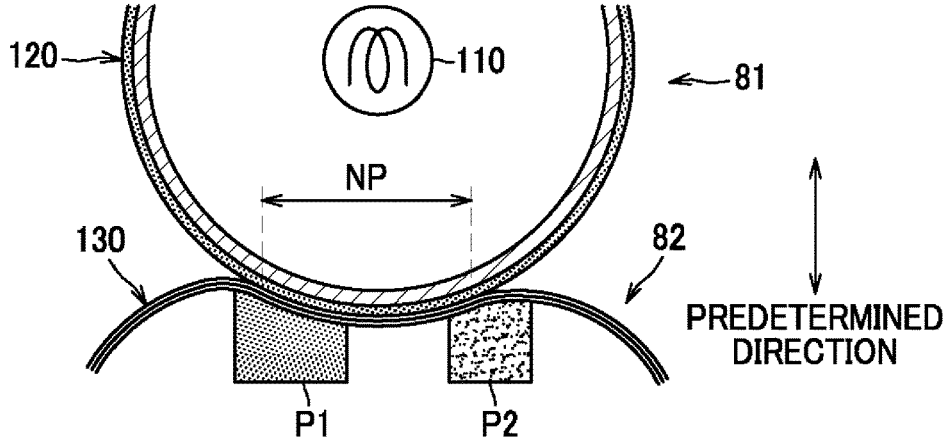
FIG. 6B is a section view showing a nip region, with its surrounding structural features, when the nip pressure is adjusted to the second pressure.

Since the arm body 311 assumes the first position regardless of whether the second spring 330 is in the first compression state or in the second compression state, both of the first pad P1 and the second pad P2 nip the belt 130 in combination with the roller 120 under both conditions, where the nip pressure is adjusted to the first nip pressure and where the nip pressure is adjusted to the second nip pressure, as shown in FIG. 5B and FIG. 6B. More specifically, the position of the second fixing member 82 relative to the roller 120 is substantially the same under both conditions, and thus the width (length in the moving direction) of the nip region NP is substantially the same under both conditions.

When the cam 340 rotates from the second cam position shown in FIG. 6A to the third cam position shown in FIG. 7A, the cam 340 causes the cam follower 350 to further move relative to the arm body 311 and push the arm body 311. Accordingly, the compression state of the second spring 330 changes to the third compression state in which the second spring 330 is deformed more than in the second compression state, and the arm body 311 is caused to rotate from the first position to the second position different from the first position.

To be more specific, in the first stage of the process of rotation of the cam 340 from the second cam position to the third cam position, the cam follower 350 moves relative to the arm body 311, and the contact portion 352 of the cam follower 350 approaches the end of the guide protrusion 312. When the contact portion 352 contacts the end of the guide protrusion 312, the compression state of the second spring 330 changes to the third compression state. Accordingly, when the cam 340 causes the second spring 330 to assume the third compression state, the contact portion 352 that is part of the cam follower 350 is held between the cam 340 and the guide protrusion 312. In other words, the contact portion 352 not only contacts the cam 340 but also contacts the guide protrusion 312. Thereafter, the cam 340 further caused to rotate pushes the contact portion 352 which in turn pushes the guide protrusion 312, and the arm body 311 thereby rotates against the biasing force of the first spring 320 from the first position to the second position.

Figure 7B:
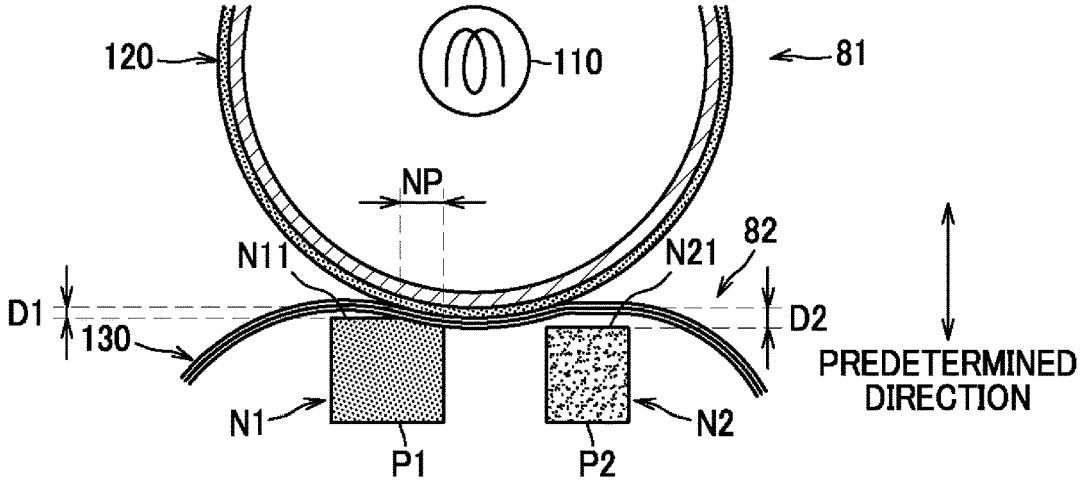
FIG. 7B is a section view showing a nip region, with its surrounding structural features, when the nip pressure is adjusted to the third pressure.

In this way, when the arm body 311 is in the second position, the second fixing member 82 is located in a position farther apart from the roller 120 (the position of FIG. 7B) than a position in which the second fixing member 82 is located when the arm body 311 is in the first position (the position of FIG. 6B). Such change in the position of the second fixing member 82 relative to the roller 120 makes the width of the nip region NP smaller when the arm body 311 is in the second position than when the arm body 311 is in the first position, as shown in FIG. 7B, and the nip pressure is adjusted to a third nip pressure smaller than the second nip pressure. That is, the nip pressure and the nip width are changed by the cam 340 changing the position of the arm 310. To be more specific, when the arm 310 is in the second position, the belt 130 is held only between the first pad P1 and the roller 120 and not held between the second pad P2 and the roller 120. Therefore, when the arm 310 is in the second position, the upstream nip pressure and the upstream nip width become smaller, and the downstream nip pressure becomes zero.

Figure 8A:
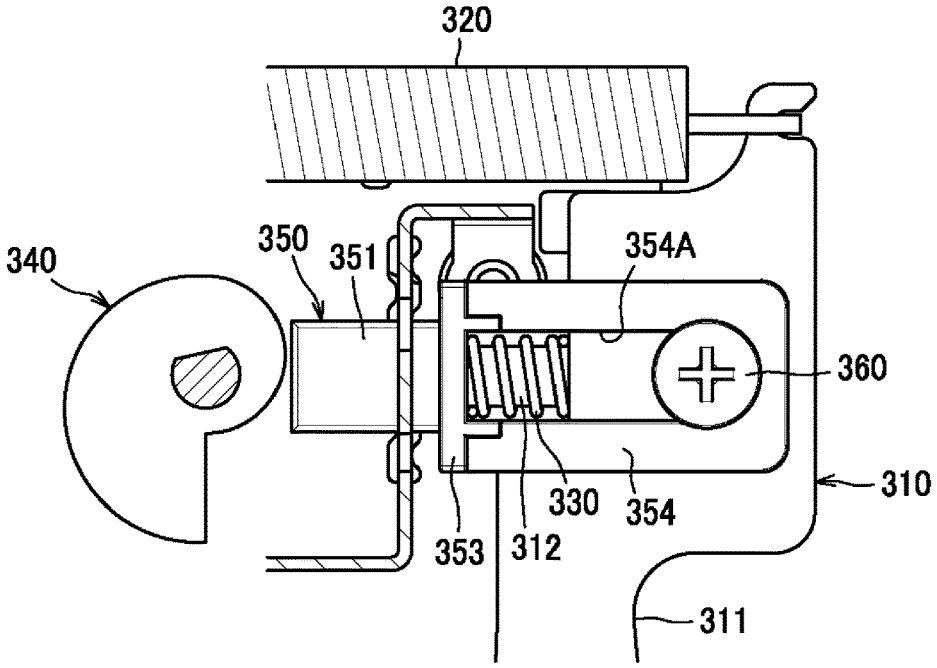
FIG. 8A shows relative positions and configurations of a cam follower, a screw, and associated structures.
Figure 8B:
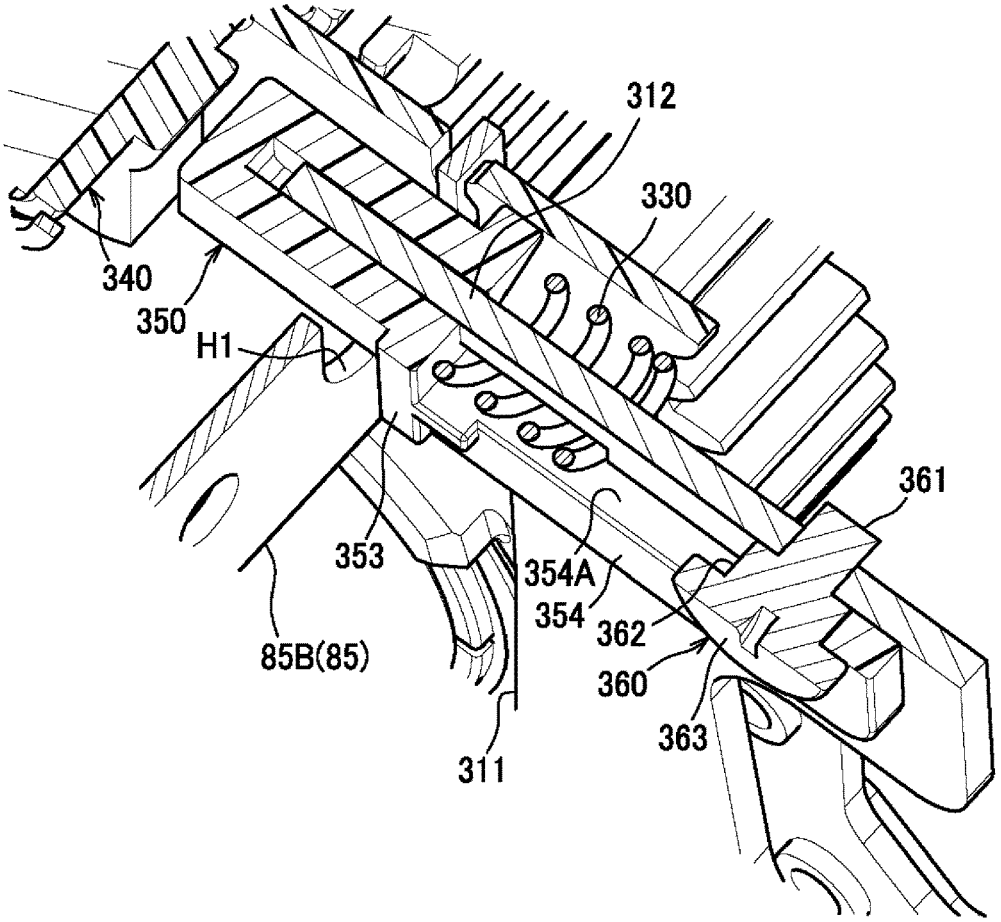
FIG. 8B is a perspective view of the cam follower, a second screw, an arm body, and associated structures, with part of the structures cut away.

As shown in FIG. 8, the arm 310 further includes a screw 360. The screw 360 is a stepped screw made of metal or the like. The screw 360 restricts the movement of the cam follower 350 toward the cam 340. The screw 360 includes a shaft portion 361 with threads on an outer surface thereof, a large-diameter portion 362 with a diameter larger than that of the shaft portion 361, and a head 363 with a diameter larger than that of the large-diameter portion 362. The large-diameter portion 362 is positioned between the shaft portion 361 and the head 363. The screw 360 is fastened to the arm body 311 with the large-diameter portion 362 in contact with a surface of the arm body 311.

On the other hand, the cam follower 350 further includes an extended portion 354 that extends from the flange portion 353 toward the screw 360. The extended portion 354 has a slot 354A that engages with the large-diameter portion 362, and is capable of sliding along the surface of the arm body 311.

The slot 354A is a long hole elongate in the protruding direction of the guide protrusion 312. The large-diameter portion 362 engages the screw 360-side end of the slot 354A, and thus the movement of the cam follower 350 toward the cam 340 is restricted by the screw 360.

The extended portion 354 is interposed between the head 363 of the screw 360 and the arm body 311. The cam follower 350 is thereby movably supported by the arm body 311 without being disengaged from the arm body The controller 100 includes, for example, a CPU, a RAM, a ROM, and an input/output circuit. The controller 100 is capable of selecting and executing, depending on a type of the sheet S subjected to printing, a strong nip process as an example of a first printing process, an intermediate nip process, and a weak nip process as an example of a second printing process.

The controller 100 executes the strong nip process if the type of the sheet S is a sheet with a first thickness, for example, plain paper. The strong nip process is a process in which the nip pressure is set at the first nip pressure which is a highest nip pressure. In the strong nip process, the controller 100 locates the second fixing member 82 in a position where both of the first nip forming member N1 and the second nip forming member N2 nip the belt 130 in combination with the first fixing member 81 and executes printing. In other words, in the strong nip process, the controller 100 brings the state of the first fixing member 81 and the second fixing member 82 to a first state in which both of the first nip forming member N1 and the second nip forming member N2 nip the belt 130 in combination with the first fixing member 81.

Specifically, in the strong nip process, the controller 100 locates the cam 340 in the first cam position shown in FIG. 5A. The cam 340 in the first cam position does not contact the cam follower 350 of the arm 310, and locates the second fixing member 82 in a position where both of the first nip forming member N1 and the second nip forming member N2 nip the belt in combination with the first fixing member 81. Since the cam 340 does not contact the arm 310 as described above during the strong nip process, the first biasing force of the first spring 320 is exerted on the first nip forming member N1 and the second nip forming member N2. In the strong nip process, the second pad P2 having a greater hardness than that of the first pad P1 is strongly pressed against the first fixing member 81, thereby an advantageous effect such as a higher gloss provided for example, during color printing can be achieved.

The controller 100 executes the intermediate nip process if the type of the sheet S is a sheet having a second thickness greater than the first thickness, for example, a cardboard. The intermediate nip process is a process in which the nip pressure is set at the second nip pressure smaller than the first nip pressure. In the intermediate nip process, the controller 110 locates the cam 340 in the second cam position shown in FIG. 6A.

When the cam 340 is rotated from the first cam position to the second cam position, the position of the arm 310 is kept in the same first position as in the strong nip process, while the cam follower 350 is pushed by the cam 340 and approaches the arm body 311. Accordingly, the second spring 330 is more compressed than in the strong nip process. Therefore, in the intermediate nip process, the position of the second fixing member 82 is the same as in the strong nip process, but the nip pressure is adjusted to the second nip pressure smaller than the first nip pressure, since the biasing force of the second spring 330 acts on the arm 310 in a direction opposite to the direction of the biasing force of the first spring 320.

The controller 100 executes the weak nip process if the type of the sheet S is a sheet having a third thickness greater than the second thickness, for example, an envelope. The weak nip process is a process in which the nip pressure is set at the third nip pressure smaller than the second nip pressure. In the weak nip process, the controller 110 locates the second fixing member 82 in a position where the first nip forming member N1 nips the belt 130 in combination with the first fixing member 81, but the second nip forming member N2 does not nip the belt 130 in combination with the first fixing member 81 and executes printing. In other words, in the weak nip process, the controller 100 brings the state of the first fixing member 81 and the second fixing member 82 to a second state in which the first nip forming member N1 nips the belt 130 in combination with the first fixing member 81, but the second nip forming member N2 does not nip the belt 130 in combination with the first fixing member 81.

Specifically, in the weak nip process, the controller 100 locates the cam 340 in the third cam position shown in FIG. 7A. The cam 340 in the third cam position is in contact with the cam follower 350 of the arm 310 to locate the second fixing member 82 in a position where the first nip forming member N1 nips the belt 130 in combination with the first fixing member 81, but the second nip forming member N2 does not nip the belt 130 in combination with the first fixing member 81.

To be more specific, the cam 340 pushes the cam follower 350 which in turn pushes the arm body 311 against the biasing force of the first spring 320, and thereby causes the arm 310 to rotate to the second position where the second fixing member 82 is located in a position further apart from the first fixing member 81 than in the strong nip process or the intermediate nip process. Accordingly, only the first nip forming member N1 is pressed against the first fixing member 81.

In the weak nip process, the contact portion 352 of the cam follower 350 is in contact with the arm body 311, thus the movement of the arm 310 toward the first fixing member 81 is restricted by the cam 340. Accordingly, in the weak nip process, the biasing force of the first spring 320 is not exerted on the first nip forming member N1. In the weak nip process, since the second pad P2 with a hardness higher than that of the first pad P1 is not pressed against the first fixing member 81, a difference between conveyance speeds of a front surface and a back surface of a sheet with double layers, for example, an envelope can be made less likely to occur, and thus an advantageous effect such as reducing degradation of an image during fixing can be achieved.

Next, the operation of the controller 100 will be described in detail.

Figure 9:
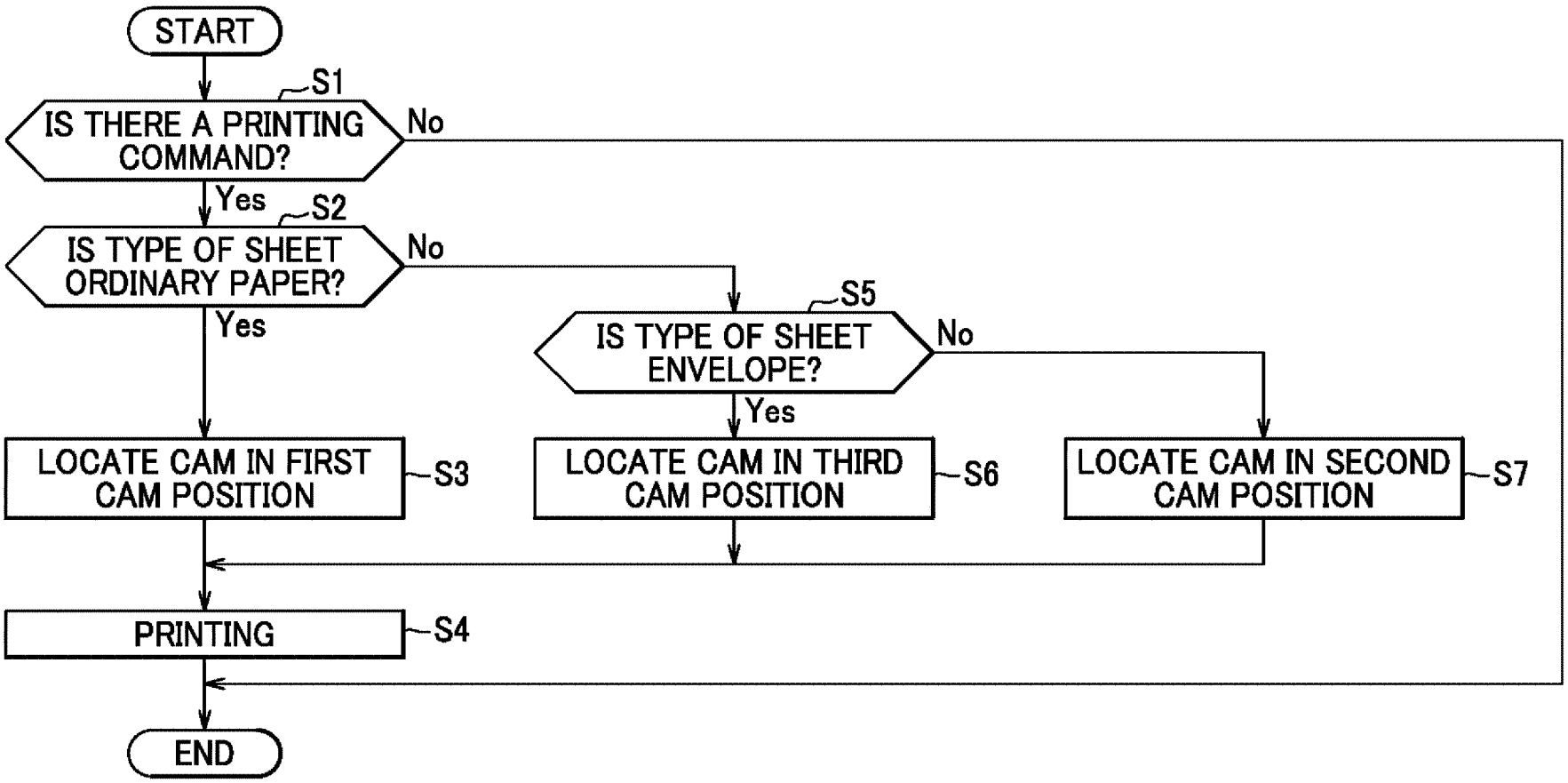
FIG. 9 is a flow chart of an operation of a controller.

As shown in FIG. 9, the controller 100 first determines whether or not there is a printing command (S1). If it is determined, in step S1, that there is no printing command (No), the controller 100 ends the present process.

If it is determined, in step S1, that there is a printing command (Yes), the controller 100 determines whether or not the type of the sheet S is plain paper (S2). As one example, the controller 100 determines that the sheet S is plain paper if the type of the sheet S designated by the user is plain paper. If it is determined, in step S2, that the sheet S is a plain paper (Yes), the controller 100 locates the cam 340 in the first cam position (S3) and executes printing (S4). That is, if the type of the sheet S is plain paper, the controller 100 executes the strong nip process in which both of the first nip forming member N1 and the second nip forming member N2 nip the belt 130 in combination with the first fixing member 81 and only the biasing force of the first spring 320 is exerted on the respective nip forming members N1, N2. After step S4, the controller 100 ends the present process.

If it is determined, in step S2, that the sheet S is not a plain paper (No), the controller 100 determines whether or not the type of the sheet S is envelope (S5). As one example, the controller 100 determines that the sheet S is an envelope if the type of the sheet S designated by the user is envelope. If it is determined, in step S5, that the sheet S is an envelope (Yes), the controller 100 locates the cam 340 in a third cam position (S6) and executes printing (S4). That is, if the type of the sheet S is envelope, the controller 100 executes the weak nip process in which only the first nip forming member N1 nips the belt 130 in combination with the first fixing member 81, and the biasing force of the first spring 320 is not exerted on the first nip forming member N1.

If it is determined, in step S5, that the sheet S is not an envelope, the controller 100 locates the cam 340 in a second cam position (S7) and executes printing (S4). That is, if the type of the sheet S is a type other than plain paper or envelope, the controller 100 executes the intermediate nip process in which both of the first nip forming member N1 and the second nip forming member N2 nip the belt 130 in combination with the first fixing member 81 and the biasing force of the first spring 320 weakened by the biasing force of the second spring 330 is exerted on the respective nip forming members N1, N2.

In the illustrative, non-limiting embodiment described above, the following advantageous effects can be achieved.

Since the end faces N11, N21 of the two nip forming members N1, N2 are located in different positions in the predetermined direction with respect to the first fixing member 81, the mode can be switched between a mode in which printing is executed in a nip region NP formed by the two nip forming members N1, N2, and a mode in which printing is executed in a nip region NP formed by only one nip forming member which is the first nip forming member N1 by only moving the second fixing member 82 in the predetermined direction. Therefore, switching between the two modes can be realized by a simple structure.

Since the frame FL has a first slot 84A configured to support the second fixing member 82 in a manner that permits the second fixing member 82 to move in the predetermined direction, the second fixing member 82 pushed by the rotating arm 310 can be caused to move with the positional relationship maintained between the first fixing member 81 and the second fixing member 82 in the direction orthogonal to both the predetermined direction and the axial direction.

Since the first nip forming member N1 having the first end face N11 closer, than the second end face N21, to the first fixing member 81 is positioned upstream of the second nip forming member N2 in the conveyance direction, it is possible to fix a toner image on a sheet in an entrance-side part of the nip region NP during both the first printing process and the second printing process, and thereby reduce disturbances in the toner image.

By causing the second nip forming member N2 having the greater hardness of the two nip forming members N1, N2 to be pressed against the sheet S, it is possible to provide a gloss to a toner image on a sheet S. Further, by causing only the softer first nip forming member N1 to be pressed against a sheet S, even if the sheet S is an envelope, a toner image can be properly fixed on the envelope.

Since the first nip forming member N1 and the second nip forming member N2 are located apart from each other in the conveyance direction, the respective nip forming members N1, N2 can be restrained from contacting each other when the nip forming members N1, N2 are deformed. Therefore, detrimental effects on the shape of the nip region NP or on the nip pressure due to possible contact between the nip forming members N1, N2 can be reduced.

The image forming apparatus and the method of controlling the same may be modified and implemented in various other forms as described below.

Although the controller 100 is configured to execute the weak nip process if the sheet S is an envelope in the illustrated example, the controller may be configured to be capable of executing the strong nip process, the intermediate nip process, and the weak nip process as desired regardless of the type of the sheet S. Further, the strong nip process, the intermediate nip process, and the weak nip process may be selectively executed based on predetermined conditions regardless of the type of the sheet S.

Although the second fixing member 82 is configured to move with respect to the first fixing member 81 in the illustrated example, the first fixing member may be configured to move with respect to the second fixing member. In this case, a guide may be configured to support the first fixing member in a manner that permits the first fixing member to move in the predetermined direction and the cam may be configured to move the first fixing member in the predetermined direction.

Although the respective end faces N11, N21 are located in different positions shifted in the predetermined direction in the illustrated example, the respective end faces may be located in the same positions in the predetermined direction if the nip forming members are located in such a manner that their end faces are positioned at different shortest distances from the outer peripheral surface of the first fixing member in the predetermined direction. To be more specific, by locating the first nip forming member closer, than the second nip forming member, to the rotation axis of the first fixing member in the conveyance direction, it is possible to make the shortest distance from the first end face to the outer peripheral surface of the first fixing member in the predetermined direction shorter than the shortest distance from the second end face to the outer peripheral surface of the first fixing member in the predetermined direction Although the dimension of the first nip forming member N1 in the predetermined direction is different from that of the second nip forming member N2 in the illustrated example, the dimensions of the nip forming members N1, N2 in the predetermined direction may be the same. In this case, by locating the first support surface of the holder closer, than the second support surface of the holder, to the first fixing member, each end face may be located at different shortest distances in the predetermined direction from the outer peripheral surface of the first fixing member.

Although the heater 110 is configured to heat the first fixing member 81 in the illustrated example, the heater 110 may be configured to heat the second fixing member. The heater 110 may be any kind of heater, for example, it may be a carbon heater, etc. Further, there may be more than one heater.

Although each nip forming member is formed by a pad and a fastening plate in the illustrated example, each nip forming member may be formed by, for example, only the pad.

Although the second spring 330 and the cam follower 350 are included in the illustrated example, the second spring 330 and the cam follower 350 do not have to be included. That is, the cam may be configured to directly push the arm body.

The first spring is a helical tension spring, and the second spring is a helical compression spring, in the illustrated example. However, for example, the first spring may be a helical compression spring, and the second spring may be a helical tension spring.

The biasing force of the first spring 320 and the second spring 330 are exerted on the second fixing member 82 via the arm 310 in the illustrated example. However, for example, the biasing force of the first spring and the second spring may be directly exerted on the second fixing member.

The first spring and the second spring are not limited to a coil spring as described above, but may, for example, be a torsion spring, a leaf spring, etc.

An external heating system in which a heater is disposed outside the first fixing member to heat an outer surface of the first fixing member, or an induction heating (IH) system may be adopted as the system for heating the first fixing device or the second fixing device by a heater. Another alternative configuration in which a heater is provided in the second fixing member to indirectly heat the first fixing member in contact with the outer periphery of the second fixing member is also possible. Each of the first fixing member and the second fixing member may be configured to incorporate a heater.

The second fixing member 82 is moved by a cam configured to rotate in the illustrated example. However, the second fixing member may be moved by a translation cam configured to move linearly or by a rod of an air cylinder caused to advance or retreat.

Although the first pad P1 and the second pad P2 described above are both made of rubber, the pads may be made, for example, made of plastic, metal or other hard material resistant to deformation even under pressure.

Although the image forming unit 4 includes a photoconductor drum 61, a charger 62, etc., in the illustrated example, the image forming unit may comprise a belt type photoconductor, a charged roller, etc.

The elements described in the above embodiment and its modified examples may be implemented selectively and in combination.

What is claimed is:

1. An image forming apparatus comprising:

a first fixing member including a roller;

a second fixing member configured to nip a sheet in combination with the first fixing member, the second fixing member including:

an endless belt;

a first nip forming member and a second nip forming member which are each configured to nip the endless belt in combination with the first fixing member to form a nip region in which the sheet is nipped between the endless belt and the roller, the first nip forming member having a first end face that faces the first fixing member, and the second nip forming member having a second end face that faces the first fixing member; and a single holder configured to support the first nip forming member and the second nip forming member in such a manner that the first nip forming member and the second nip forming member are moved together;

a heater that heats the first fixing member or the second fixing member;

a guide configured to support the holder in a manner that permits the first nip forming member and the second nip forming member supported by the holder to move with respect to the first fixing member in a predetermined direction toward or away from the first fixing member;

a spring configured to bias the second fixing member toward the first fixing member;

a cam configured to move the second fixing member in the predetermined direction; and a controller, wherein the controller is capable of executing:

a first printing process in which printing is performed with the holder located in a position where both of the first nip forming member and the second nip forming member nip the endless belt in combination with the first fixing member, and a second printing process in which printing is performed with the holder located in a position where the first nip forming member nips the endless belt in combination with the first fixing member, but the second nip forming member does not nip the endless belt in combination with the first fixing member, wherein the first end face is located closer to the first fixing member than the second end face, in a state where the second printing process is being executed wherein the first nip forming member and the second nip forming member are made of rubber, and wherein the first nip forming member is softer than the second nip forming member and located upstream of the second nip forming member in a direction of conveyance of the sheet.

2. The image forming apparatus according to claim 1, wherein, in the first printing process, a biasing force of the spring is exerted on the first nip forming member and the second nip forming member, and wherein, in the second printing process, the biasing force of the spring is not exerted on the first nip forming member and the second nip forming member.

3. The image forming apparatus according to claim 1, further comprising a frame configured to support ends of the first fixing member, in an axial direction of the first fixing member, wherein the frame includes a groove as the guide, the groove being elongate in the predetermined direction.

4. The image forming apparatus according to claim 1, further comprising an arm configured to be rotatable, and biased by the spring to press the second fixing member against the first fixing member.

5. The image forming apparatus according to claim 4, wherein the cam is configured such that:

in a state in which the cam is not in contact with the arm, the second fixing member is located in a position where both of the first nip forming member and the second nip forming member nip the endless belt in combination with the first fixing member, and in a state in which the cam is in contact with the arm, the second fixing member is located in a position where the first nip forming member nips the endless belt in combination with the first fixing member, but the second nip forming member does not nip the endless belt in combination with the first fixing member.

6. The image forming apparatus according to claim 5, wherein the controller is configured to:

keep the cam from contacting the arm during execution of the first printing process, and bring the cam into contact with the arm during execution of the second printing process.

7. The image forming apparatus according to claim 1, wherein the first nip forming member and the second nip forming member are respectively supported on surfaces of the holder located at the same positions in the predetermined direction.

8. The image forming apparatus according to claim 1, wherein the first nip forming member and the second nip forming member are rectangular parallelepiped members.

9. The image forming apparatus according to claim 1, wherein the first nip forming member is located apart from the second nip forming member in a direction of conveyance of the sheet, and the first nip forming member and the second nip forming member are respectively biased forward directions away from each other by a holder spring.

10. The image forming apparatus according to claim 1, wherein the controller is configured to:

execute the first printing process if a type of sheet for printing is plain paper, and execute the second printing process if the type of sheet for printing is envelope.

11. A method for controlling an image forming apparatus including a fixing device, the fixing device comprising:

a first fixing member;

a second fixing member configured to nip a sheet in combination with the first fixing member, the second fixing member including:

an endless belt;

a first nip forming member and a second nip forming member which are each configured to nip the endless belt in combination with the first fixing member to form a nip region in which the sheet is nipped between the endless belt and the first fixing member, the first nip forming member having a first end face that faces the first fixing member, and the second nip forming member having a second end face that faces the first fixing member; and a single holder configured to support the first nip forming member and the second nip forming member in such a manner that the first nip forming member and the second nip forming member are moved together;

a heater; and a guide configured to support the holder in a manner that permits the first nip forming member and the second nip forming member supported by the holder to move with respect to the first fixing member in a predetermined direction toward or away from the first fixing member;

the method comprising executing:

a first printing process in which printing is performed with the holder located in a position where both of the first nip forming member and the second nip forming member nip the endless belt in combination with the first fixing member, and a second printing process in which printing is performed with the holder located in a position where the first nip forming member nips the endless belt in combination with the first fixing member, but the second nip forming member does not nip the endless belt in combination with the first fixing member, and wherein the first end face is located closer to the first fixing member than the second end face, in a state where the second printing process is being executed, wherein the first nip forming member and the second nip forming member are made of rubber, and wherein the first nip forming member is softer than the second nip forming member and located upstream of the second nip forming member in a direction of conveyance of the sheet.

12. An image forming apparatus including a fixing device, the fixing device comprising:

a roller;

an endless belt;

a first pad having a first end face that faces the roller, and configured to nip the endless belt in combination with the roller;

a second pad having a second end face that faces the roller, and configured to nip the endless belt in combination with the roller;

a single holder configured to support the first pad and the second pad in such a manner that first pad and the second pad are moved together;

a heater;

a guide configured to support the holder in a manner that permits the first pad and the second pad supported by the holder to move with respect to the roller in a predetermined direction toward or away from the roller;

a spring configured to bias the holder toward the roller; and a cam configured to move the holder in the predetermined direction;

wherein the image forming apparatus is capable of executing:

a first printing process in which printing is performed with the holder located in a position where both of the first pad and the second pad nip the endless belt in combination with the roller, and a second printing process in which printing is performed with the holder located in a position where the first pad nips the endless belt in combination with the first fixing member, but the second pad does not nip the endless belt in combination with the first fixing member, wherein the first end face is located closer to the roller than the second end face, in a state where the second printing process is being executed and wherein the first pad is softer than the second pad and located upstream of the second pad in a direction of conveyance of the sheet.

13. The image forming apparatus according to claim 12, wherein, in the first printing process, a biasing force of the spring is exerted on the first pad and the second pad, and wherein, in the second printing process, the biasing force of the spring is not exerted on the first pad and the second pad.

14. The image forming apparatus according to claim 12, wherein the fixing device further comprises a frame configured to support ends of the roller, and wherein the frame includes a groove as the guide, the groove being elongate in the predetermined direction.

15. The image forming apparatus according to claim 12, wherein the fixing device further comprises an arm configured to be rotatable, the arm being biased by the spring to press the holder against the roller.

16. The image forming apparatus according to claim 15, wherein the cam is configured such that:

in a state in which the cam is not in contact with the arm, the holder is located in a position where both of the first pad and the second pad nip the endless belt in combination with the roller, and in a state in which the cam is in contact with the arm, the holder is located in a position where the first pad nips the endless belt in combination with the roller, but the second pad does not nip the endless belt in combination with the roller.

17. The image forming apparatus according to claim 16, wherein the first printing process is performed in a state where the cam is not in contact with the arm, and wherein the second printing process is performed in a state where the cam is in contact with the arm.

18. The image forming apparatus according to claim 12, wherein the first pad and the seond pad are supported on the holder without a spring being positioned between the first pad and the holder and between the second pad and the holder.

19. The image forming apparatus according to claim 12, wherein the first pad and second pad are rectangular parallelepiped members.

20. The image forming apparatus according to claim 12, wherein the first pad is located apart from the second pad in a direction of conveyance of a sheet, and the first pad and the second pad are respectively biased toward directions away from each other by a holder spring.

* * * * *